US007977855B2

(12) United States Patent
Wimberly

(10) Patent No.: US 7,977,855 B2
(45) Date of Patent: Jul. 12, 2011

(54) INCANDESCENT LAMP AND ILLUMINATION SYSTEM WITH OPTIMIZED FILAMENT SHAPE AND SIZE

(76) Inventor: Randal Lee Wimberly, Lake Havasu City, AZ (US)

( * ) Notice: Subject to any disclaimer, the term of this patent is extended or adjusted under 35 U.S.C. 154(b) by 815 days.

(21) Appl. No.: 11/316,782

(22) Filed: Dec. 22, 2005

(65) Prior Publication Data

US 2007/0145876 A1 Jun. 28, 2007

(51) Int. Cl.
*H01K 1/26* (2006.01)
*H01K 1/50* (2006.01)

(52) U.S. Cl. ..... 313/113; 313/270; 313/578; 313/271; 313/273

(58) Field of Classification Search ..... 313/113, 313/623–625, 634–636, 493, 318.12, 570, 313/270–273; 118/50; 445/26, 27; 378/136
See application file for complete search history.

(56) References Cited

U.S. PATENT DOCUMENTS

| | | | | |
|---|---|---|---|---|
| 2,218,345 | A | 8/1940 | Spaeth | |
| 4,316,116 | A * | 2/1982 | Graves et al. | 313/344 |
| 4,686,412 | A | 8/1987 | Johnson, Jr. | |
| 4,918,354 | A * | 4/1990 | Johnson, Jr. | 313/279 |
| 4,918,356 | A * | 4/1990 | Enyedy et al. | 313/579 |
| 5,268,613 | A | 12/1993 | Cunningham | |
| 5,508,587 | A * | 4/1996 | Williams et al. | 313/578 |
| 6,034,473 | A | 3/2000 | McBride, Jr. et al. | |
| 6,469,426 | B1 * | 10/2002 | Hurst et al. | 313/315 |
| 6,525,452 | B1 | 2/2003 | Guinard | |
| 6,744,187 | B1 | 6/2004 | Wimberly | |

* cited by examiner

*Primary Examiner* — Karabi Guharay
*Assistant Examiner* — Elmito Breval

(57) ABSTRACT

An incandescent lamp that is specially adapted for use in combination with a concave reflector in providing a high-intensity beam of light. The lamp includes an optimized filament shape that consist of a filament arranged in coiled coils having a longitudinal axis perpendicular to the reflector longitudinal axis and the larger coils of the coiled coil filament spaced from each other by a distance substantially the same as the filament coil diameter. The filament length, width, and height can be limited to substantially twelve millimeters to optimize the lamp for use with concave reflectors having a focal length of substantially twenty five millimeters, any type curvature, and any size diameter.

20 Claims, 5 Drawing Sheets

INCANDESCENT LAMP AND ILLUMINATION SYSTEM WITH OPTIMIZED FILAMENT SHAPE AND SIZE

REFERENCES CITED:

| | | |
|---|---|---|
| U.S. Pat. No. 6,744,187 | August, 1940 | Spaeth |
| U.S. Pat. No. 4,686,412 | April, 1987 | Johnson, Jr. |
| U.S. Pat. No. 5,268,613 | Dec. 7, 1993 | Cunningham |
| U.S. Pat. No. 6,034,473 | Mar. 7, 2000 | McBride, Jr., et al |
| U.S. Pat. No. 6,525,452 B1 | Feb. 25, 2003 | Guinard |
| U.S. Pat. No. 6,744,187 | June 2004 | Wimberly |

BACKGROUND OF THE INVENTION

This invention relates generally to incandescent illumination systems or fixtures and, more particularly, to incandescent lamps adapted for use in combination with a concave reflector in collecting a high proportion of the emitted light and projecting a high-intensity beam with a smooth and even beam pattern.

Incandescent lamps of this particular kind are useful in theater, television, architectural, and general purpose lighting fixtures that provide high-intensity beams of light. In such fixtures, it is desirable to collect as high a percentage of the emitted light as possible and to redirect that collected light as a high-intensity beam having a desired intensity distribution. The most popular lighting fixtures of this type use reflectors that have various size diameters up to 8 inches in diameter and have focal points located 25 to 30 millimeters from the base of said reflector. Lamp manufacturers use these dimensions to make lamps that can easily and interchangeably be used in these reflector systems and fixtures.

Incandescent lamps of this kind commonly are used in combination with ellipsoid or near-ellipsoidal reflectors. The lamps are positioned with their light-emitting filaments located at or near a general focal point close to the reflector, such that emitted light impinging on the reflector is redirected through a gate to a lens that then projects the high-intensity beam.

Alternatively, such lamps can be used in combination with parabolic or near-parabolic reflectors. The lamp is positioned with its filaments at or near the reflector's general focal point such that emitted light impinging on the reflector is redirected to form the projected beam without the need for a lens. However, a lens sometimes is used to alter the projected beam's divergence or spread or to integrate the beam and thereby provide a desired intensity distribution.

Incandescent lamps used in illumination systems of this kind typically have included a filament in the form of one continuous coiled coil having a longitudinal axis. This type of filament is easier to manufacture because it generally has only two main contacts and support points. The filament typically is oriented with its longitudinal axis parallel to the longitudinal axis of the lamp and reflector.

A few lamps with their filaments perpendicular to the longitudinal axis, such as the DYS ANSI code lamp and others, have been made but the coiled coils of the filament are spaced apart at a distance that has been varied and unspecified. Also the longitudinal length of these coiled coil filaments have always been longer than the height or diameter of said filament and none have a spherical overall shape. Additionally these lamps are not able to be used with the reflector systems and fixtures listed above due to the fact that they are made with different types of lamp bases and shorter lamp envelopes that place the filament in the wrong position to align with the focal point of said reflector systems and fixtures.

Other incandescent lamps used in illumination systems of this kind have included a plurality of linear, helically-wound coils arranged in one or more parallel rows and various other configurations that form a light-emitting source. These complicated structures have been made in an effort to have more points of the filament fall at, or be closer to, the absolute center of the filament providing a light source that is closer to a point source. These types of filaments are more difficult to manufacture because they have multiple support points and contacts to be made to complete the filament circuit.

It is known that there is a single point in a reflector that is the most efficient point to place the light source and that point is known as the focal point. In theory this point should be a point source or infinitely small point. These facts do not change no matter what the size or shape of said reflector. Cunningham U.S. Pat. No. 5,268,613, and McBride, Jr., et al. U.S. Pat. No. 6,034,473 disclosed the need to compact the light source in an effort to make it more point source and therefore more efficient.

Filament manufacturing problems and stray light radiation problems become more enhanced where higher voltages and, or, wattages are desired due to the fact that the overall filament length increases and therefore mounting arrangements for these longer filaments become more complex making it much more difficult to control the light that passes through the central angular region. This in turn requires the design of more complex reflector and lens configurations in order to effectively reflect this light into the main beam of the reflector thereby trying to increase the candle power of a lamp for a particular wattage and voltage.

The incandescent lamps described briefly above have proven to be generally satisfactory for use in combination with concave reflectors in providing high-intensity beams of light. However, it is known that some of the emitted light impinging on the reflector is redirected in an undesired manner. This happens because the light is not being emitted from a single point, but multiple parts of the filament that is arranged in coiled coils or the plurality of linear, helically-wound coils. Additionally it is known that the area between these parts of the filaments block and absorb light that is generated by the interior parts of the filament and create shadows or cause emitted light from that area to be lower in intensity, thus causing an uneven projected beam field with hot spots, shadows, and, or cloudy areas. Cunningham U.S. Pat. No. 5,268,613, also discloses the need to smooth the projected beam of light.

It should, therefore, be appreciated that there is a need for an improved incandescent lamp for use with a concave reflector. Additionally, an improved means to allow the lamp to be used in combination with a specific size or size range of concave reflectors to project a controlled high-intensity beam with a higher collection efficiency, a more even or smooth field of illumination, and easiest possible method of manufacture. The present invention fulfills this need.

BRIEF SUMMARY OF THE INVENTION

The present invention is embodied in an incandescent lamp adapted for use with a concave reflector. Additionally, the lamp filament size can be optimized for use with a specific range of concave reflectors to produce a beam of light with a smooth field of illumination that utilizes a higher proportion of the light emitted by the lamp, i.e., that provides a higher collection efficiency.

In one embodiment of the invention the incandescent lamp includes a filament that is arranged in coiled coils that have a longitudinal axis that is perpendicular to the reflector longitudinal axis and the larger coils of the coiled coil filament spaced from each other by a distance substantially the same as the coil diameter. This size gap between the coiled coils and the shape of those coils being aligned with the curvature of the reflector surface provides that a higher number of points along the entire length of coil that forms the coiled coil of the filament will incandesce and produce a solid wave front of light that is aligned with the center of said filament.

If the gap size is smaller than this, as shown in the prior art drawing FIG. 11A, the filament coils will block or absorb a substantial part of the light that is radiated from the center of the inside coiled coils and decrease efficiency. If the gap size is larger than this, as shown in the prior art drawing FIG. 11B, the wave front will include gaps in the center with lower light intensity that will be projected in the beam and appear as shadows or clouding of the beam pattern and, the size of the filament will increase to a point where it will fall outside the focal region and that light will be rendered substantially useless, thereby also decreasing efficiency.

This light radiation, in relation to the curved surface of the reflector, appears to emanate from the exact center focal point thereby assuring maximum efficiency. This synthesized solid wave front also diminishes the shadows or cloudy beam field associated with conventional incandescent filament reflector systems thereby producing a smoother field.

The concave reflector with which the incandescent lamp is adapted for use can have a diameter of virtually any size but more commonly has a range of diameters from four and one half inches to eight inches, is generally symmetrical about a longitudinal axis, and has a focal point and focal region approximately coincident with the filament at substantially twenty five to thirty millimeters from the base of said reflector.

It is disclosed that a three dimensional "focal region" for any given size reflector with a set focal length can be mathematically determined by optics ray tracing. This yields an area around the focal point where all fight emanating from this region toward the reflector will be redirected by said reflector substantially within the desired beam field or path. This area is a cylinder with the longitudinal axis parallel to the longitudinal axis of the reflector. A filament that is created with a size up to, and not larger than, this area will ensure that the highest proportion of emitted light impinges on the reflector and is substantially redirected into the desired projected beam.

The "focal region" for this reflector is a cylinder with a maximum diameter of twelve millimeters and a maximum height of twelve millimeters. These dimensions allow a range of lamps to be made that will all operate at maximum efficiency. Lamps with filaments requiring shorter lengths of wire, creating more compact filaments smaller than the twelve millimeter maximum, will have increased output and tighter beam fields. Lamps for higher voltages or longer life usage will require longer lengths of wire and can be made up to the twelve millimeter maximum dimensions. This larger filament size will create a larger beam field with less center candle power intensity but still maintain maximum efficiency.

In another embodiment of the invention, the large coils of the coiled coil filament are also of different sizes and arranged so the overall shape of the filament is a sphere. This reduces blockage of horizontal internal light radiation from points along certain adjacent coils of the filament and this increases efficiency. This also compacts the source which increases efficiency.

Other features and advantages of the present invention should become apparent from the following descriptions of the preferred embodiments, taken in conjunction with the accompanying drawings, which illustrate, by way of example, the principles of the invention.

DESCRIPTION OF THE PREFERRED EMBODIMENTS

Figure 9:
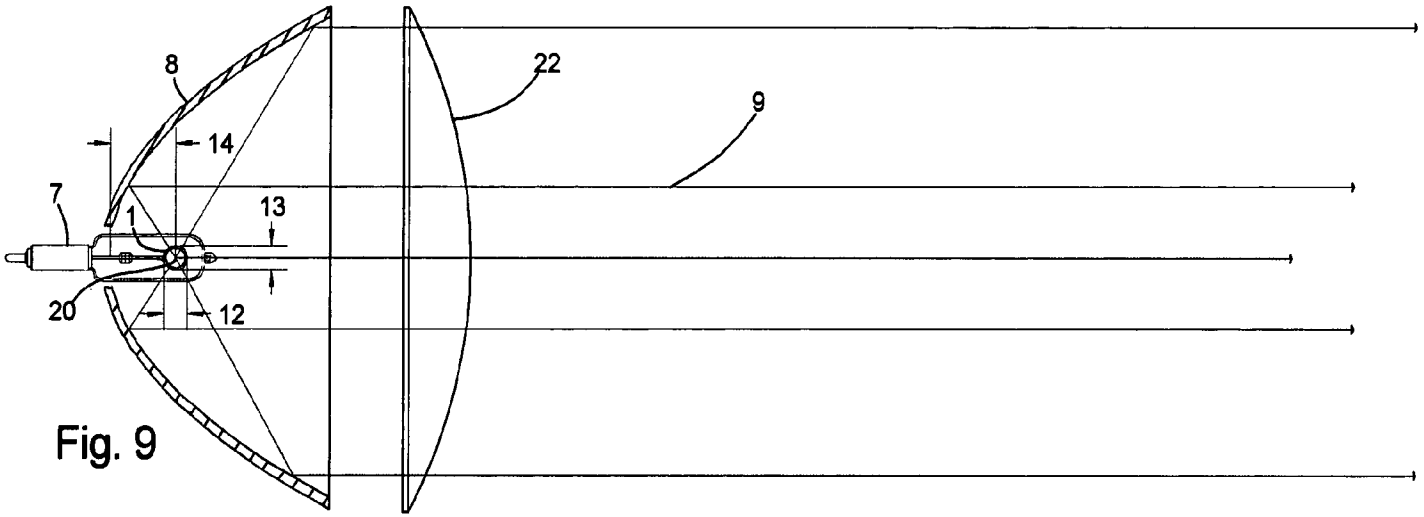
FIG. 9 is a schematic diagram of a first embodiment of an incandescent illumination system or fixture in accordance with the invention, this system including an incandescent lamp, a near-parabolic reflector, and an optional lens.

With reference now to the drawings, and particularly to FIG. 9, there is shown schematically an improved incandescent illumination system in accordance with the invention including a reflector 8 in the form of a near parabola, an incandescent lamp 7 positioned with its filament 1 within the "focal region" near the reflector's focal point 20, and an optional lens 22 to alter the beam's divergence or spread or to integrate the beam and thereby provide a desired intensity distribution. Because of the nature of a parabola, emitted light 9 impinging on the reflector is redirected along an axis substantially parallel with the reflector's longitudinal axis. A beam thereby is projected without the need for a gate or collimating lens.

Figure 1:
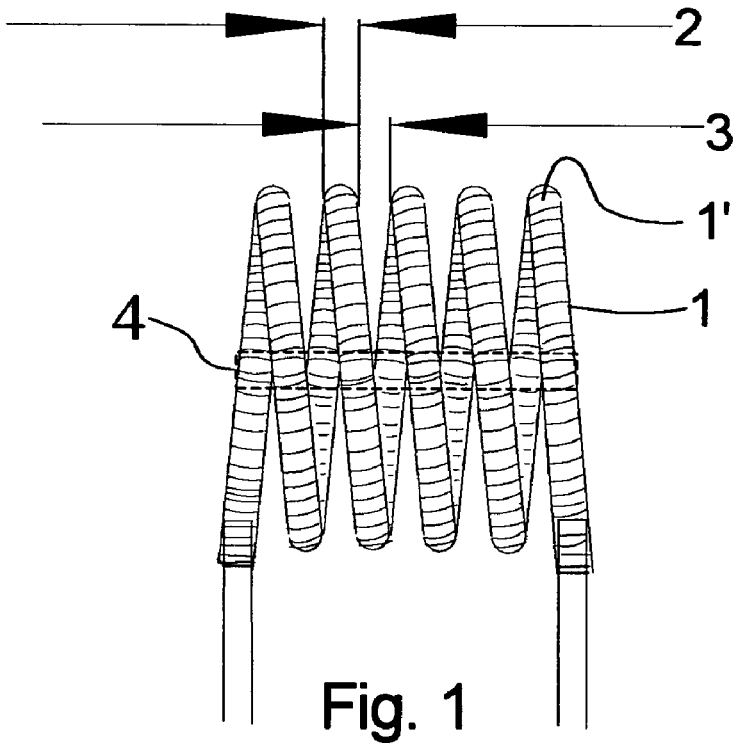
FIG. 1 is a schematic diagram of a front view of a coiled coil filament wherein the larger coiled coils are evenly spaced from each other by a distance substantially the same as the coil diameter.
Figure 11A:
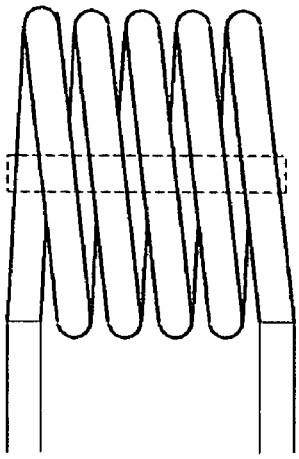
Fig. 11A prior art
FIGS. 11A and 11B are schematic diagrams of prior art filaments with their coiled coils spaced closer together and wider apart, respectively.
Figure 11B:
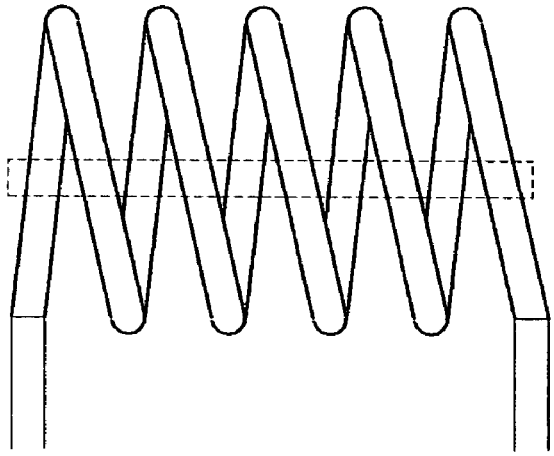
Fig. 11B prior art

The incandescent lamp 7 includes a coiled coil filament 1, also shown in FIG. 1, wherein the larger coils 1' of the coiled coil filament are evenly spaced from each other by a distance 3 substantially the same as the coil diameters 2 and arranged with the longitudinal axes substantially perpendicular with the longitudinal axis of the concave reflector. This creates an area 4 which produces a solid wave front of light that is emitted from what appears to be the exact center of said filament 1. Since the filament 1 is placed at the focal point 20, which is the theoretical most efficient point, the substantial majority of light radiating from said filament will strike the reflector at the theoretical most efficient angle possible to produce a high intensity beam of projected light.

Figures 2A, 2B:
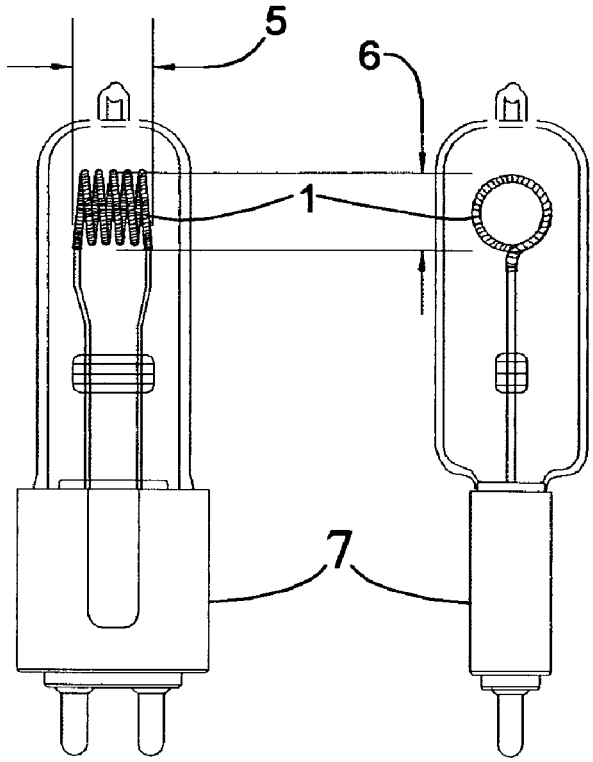
FIGS. 2A and 2B are front and side views, respectively, of a first embodiment of an incandescent lamp in accordance with the invention, this embodiment including a coiled coil filament wherein the larger coiled coils are evenly spaced from each other by a distance substantially the same as the coil diameter.

FIGS. 2A and 2B are front and side views, respectively, of a first embodiment of an incandescent lamp constructed in accordance with the invention and used in the incandescent illumination system shown in FIG. 9. This embodiment including a coiled coil filament wherein the larger coiled coils are evenly spaced from each other by a distance selected to be beyond a distance at which arcing between adjacent coiled coils can occur and as close as possible to a distance substantially the same as the coil diameter. Additionally the diameter 5 and height 6 of the filament 1 is a dimension up to the diameter 13 and height 12 dimension of the focal region 21 of said reflector 8.

When an electrical current is supplied to the filament 1, every segment of the filament will incandesce. Because of the filament's special geometric arrangement, the great majority of the emitted incandescent light is directed toward the concave reflector from a point that the reflector 8 sees as the center of the filament 1 placed at the focal point 20 of said reflector 8.

Figure 4:
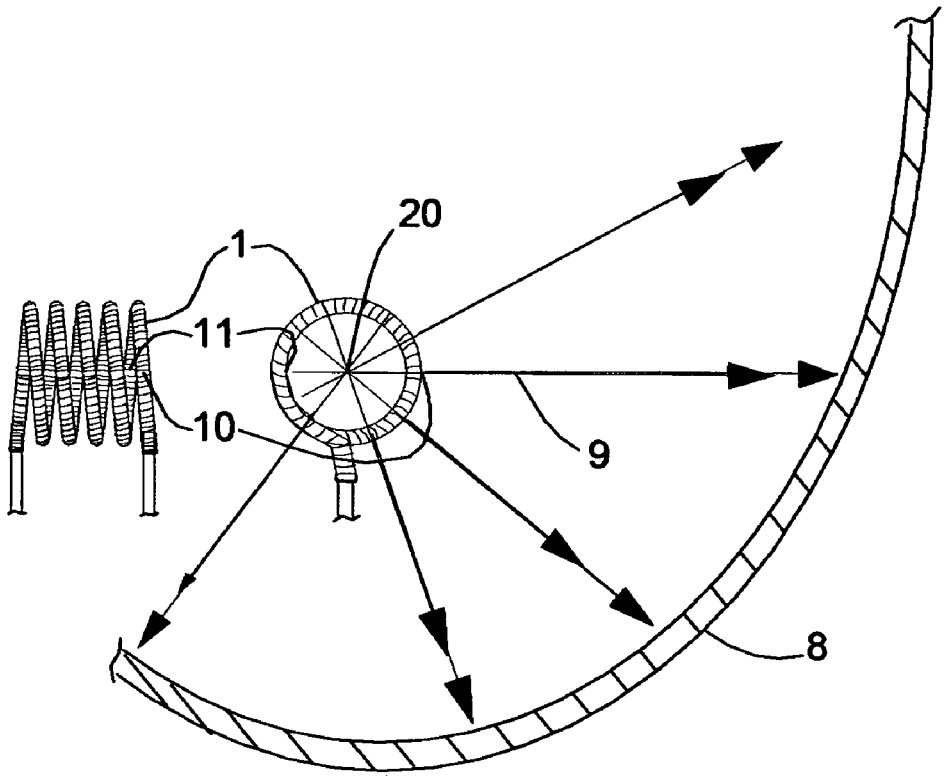
FIG. 4 is a schematic diagram of a front and side view of a coiled coil filament in accordance with the invention located at the focal point of a concave reflector.

This result is depicted in FIG. 4, which is a more detailed schematic drawing showing the filament 1 in a front view and with a side view placed at the focal point 20 of a concave reflector 8. Because of the circular nature of the coiled coils, substantially all points on the concave reflector 8 see this emitted light coming from the center 20 of the filament 1. Light being emitted from the outer front 10 of the larger coiled coils and light coming from the inside back 11 of the larger coiled coils align to produce rays 9 that strike the reflector 8 with the point of origin appearing to be the exact center of the focal point 20 and the filament 1, the theoretical most efficient point of origin.

The incandescent lamp 7 shown in FIG. 9 includes a base having means for securing it to a part of the reflector 8, with the lamp's longitudinal axis aligned with the reflector's longitudinal axis and with the lamp's light-emitting filament 1 being positioned close to the reflector's focal point 20. A substantial portion of light emitted by the filament 1 projects radially outward to impinge on the reflector 8 and be redirected generally forward.

Figure 6:
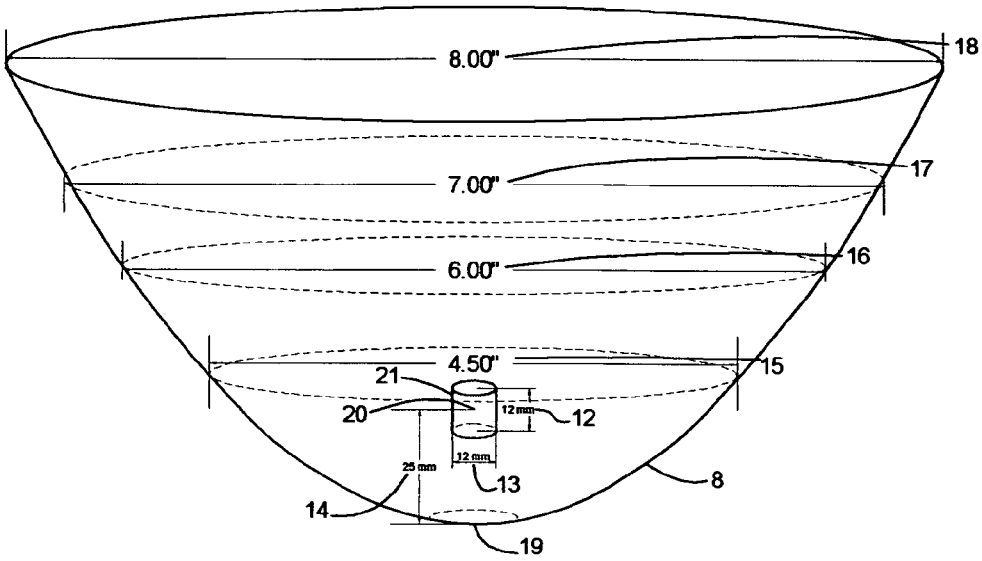
FIG. 6 is a schematic diagram of an eight inch diameter reflector with a focal point located at twenty five millimeters from the base and showing that the position of the focal point and focal region remains the same even if the diameter of said reflector is reduced.

The diameter of the reflector can vary in size as shown in FIG. 6 but the focal point 20 is substantially twenty five millimeters from the base 19 of said reflector 8.

Figure 7:
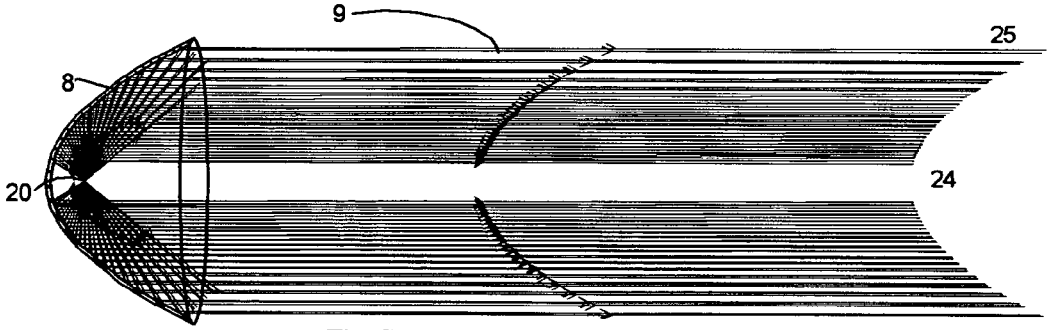
FIG. 7 is a schematic diagram of a computer generated ray tracing for a parabolic reflector system with a point source.

FIG. 7 is a computer generated schematic diagram of such a reflector 8 with a set number of rays 9 emanating from the one theoretical perfect focal point 20. This shows that equally spaced light rays generated from a source are mathematically reflected by a parabolic reflector 8 with more rays projected into the center 24 of the beam field produced by said reflector 8 and the lower concentration of light rays at the edge 25 of said beam field. This explains the extreme hot spot associated with these types of par fixtures or parabolic reflector systems when using small sources.

Figure 8:
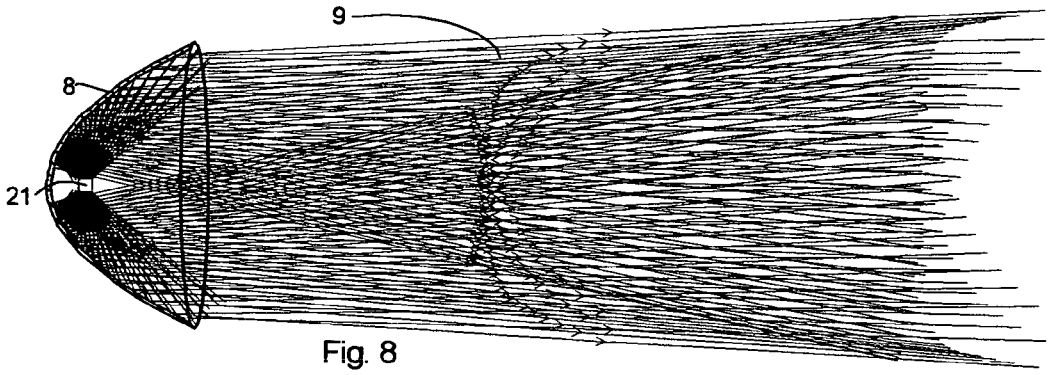
FIG. 8 is a schematic diagram of a computer generated ray tracing for a parabolic reflector system with a source radiating from the extremes of a "focal region".

FIG. 8 is a computer generated schematic diagram of such a reflector 8 with the same number of rays 9 emanating from an area defined as a "focal region" 21. All light emanating from within and up to the extremes of this area fall substantially into the desired beam field of said reflector 8.

This reflector 8 and focal region 21 is shown in more detail in FIG. 6. This shows that reflectors of varying diameter sizes, such as eight inch 18, seven inch 17, six inch 16, and four and one half inch 15, can be produced that will all have the same size focal region 21 of twelve millimeters diameter 13 and twelve millimeters height 12 with a focal point 20 substantially twenty five millimeters 14 from the base 19 of said reflector 8. The size of this area 21 is calculated to be a cylinder with its longitudinal axis parallel to the longitudinal axis of said reflector 8 and with a maximum diameter 13 and a maximum height 12 of not more than twelve millimeters.

FIG. 8 also shows that a filament with a size that fills this focal region 21 will produce a beam with a more evenly spaced ray 9 pattern or projected beam of light with less mathematical stacking of rays 9 as shown in FIG. 7. Although the reflector 8 is generally circumferentially symmetrical, its reflective surface can be smooth and specular or locally irregular to better integrate the reflected light and thereby provide the projected beam with a more circumferentially-uniform intensity distribution.

Figure 10:
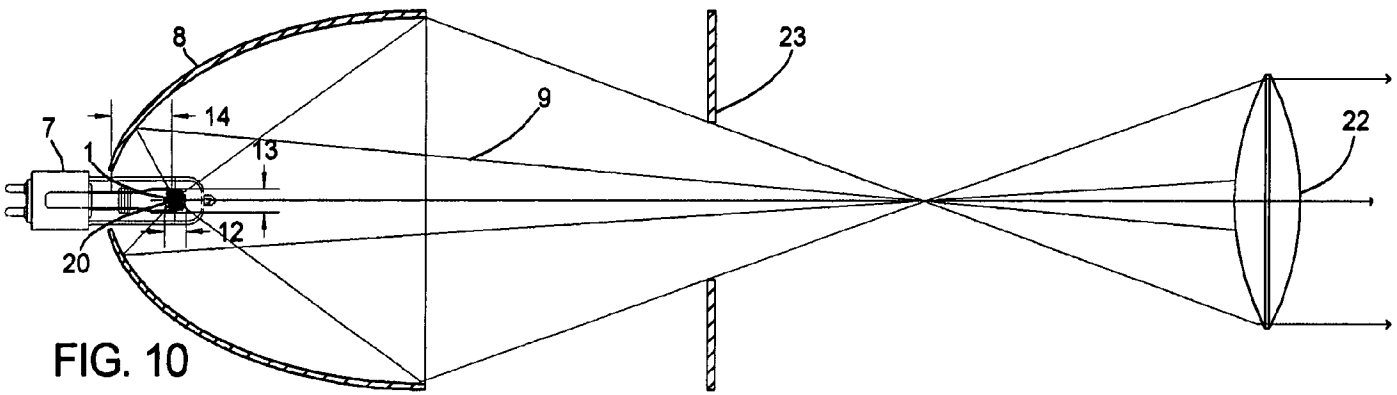
FIG. 10 is a schematic diagram of an alternate embodiment of an incandescent illumination system or fixture in accordance with the invention, including an incandescent lamp, a near-ellipsoidal reflector, a gate, and a collimating lens.

FIG. 10 is a schematic diagram of another illumination system in accordance with the invention, similar to that of FIG. 9, but for providing a high-intensity collimated beam of light The system includes an incandescent lamp 7, a concave reflector 8, an aperture stop or gate 23, and a lens 22. The reflector 8 is generally ellipsoidal in shape, with a central longitudinal axis and with a focal point 20 and focal region that surrounds it. The incandescent lamp 7 having means for securing it to a part of the reflector, with the lamp's longitudinal axis aligned with the reflector's longitudinal axis and with the lamp's light-emitting filament 1 being positioned close to the reflector's focal point 20. A substantial portion of light emitted by the filament projects radially outwardly, to impinge on the reflector and be redirected generally forwardly through the gate to the lens. The lens is positioned with its focal point approximately at the gate such that the projected beam has an intensity distribution corresponding generally with the intensity distribution at the gate.

The incandescent lamp 7 is preferably positioned relative to the reflector 8 with its filament 1 substantially in the "focal region" and as close to the reflector's general focal point as possible. To the extent that the filament is spaced away from that focal point and outside of the "focal region", the light reflected by the reflector 8 is more likely not to pass through the aperture of the gate 23 or otherwise is more likely to miss the lens 22 and thereby not be incorporated into the projected beam. In addition, the reflector's general shape is preferably adjusted to provide a substantial cosine distribution of light passing through the gate aperture.

In the past, incandescent lamps of this kind have included filaments in the form of coiled coils and linear, helically-wound coils arranged in various geometric patterns. Generally, these filaments have produced uneven beam fields with hot spots and areas of lower intensity causing shadows or cloudiness that has been included in the projected beam.

In the incandescent lamp 7 of the invention, a greater proportion of the total emitted light is caused to impinge on the reflector 8 and be redirected through the aperture of the gate 23 to the lens 22. With less light thereby being wasted and dissipated as heat, the various optical components all can be reduced in size, leading to substantial cost savings. Alternatively, without increasing the sizes of the various components, a smother beam of controlled higher intensity can be projected.

Figures 3A, 3B:
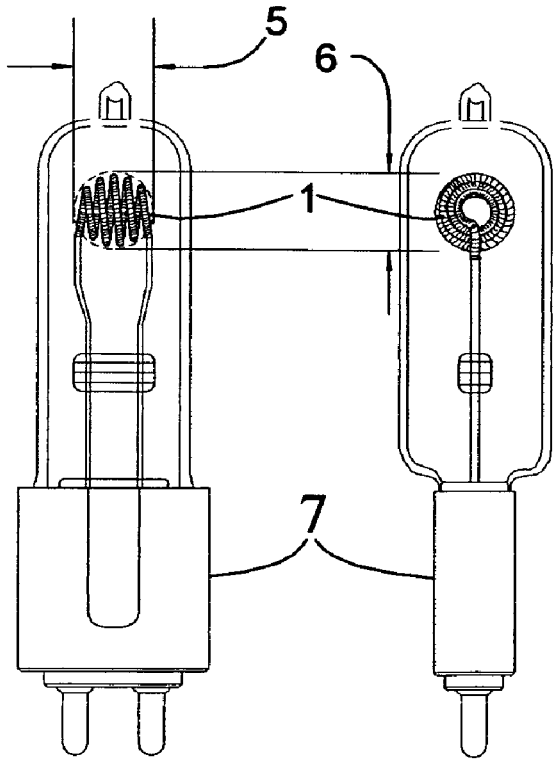
FIGS. 3A and 3B are front and side views, respectively, of a second embodiment of an incandescent lamp in accordance with the invention, this embodiment including a spherically shaped coiled coil filament wherein the larger coiled coils are evenly spaced from each other by a distance substantially the same as the coil diameters.

FIGS. 3A and 3B are front and side views, respectively, of a second embodiment of an incandescent lamp constructed in accordance with the invention and used in the incandescent illumination system shown in FIG. 10. This embodiment including a coiled coil filament wherein the larger coiled coils are evenly spaced from each other by a distance selected to be beyond a distance at which arcing between adjacent coiled coils can occur, as close as possible to a distance substantially the same as their coil diameter, and the diameters of said large coiled coils are of different sizes and arranged so the overall shape of the filament is a sphere. The smaller diameters of the outer large coiled coils reduces blockage of internal light radiation from points along certain adjacent coiled coils of the filament and allows more direct horizontal outward radiation from the side of said filament segments. Additionally the diameter 5 and height 6 of the filament 1 is a dimension up to the diameter 13 and height 12 dimension of the focal region 21 of said reflector 8.

When an electrical current is supplied to the filament 1, every segment of the filament will incandesce. Because of the filament's special geometric arrangement, the great majority of the emitted incandescent light is directed toward the concave reflector from a point that the reflector 8 sees as the center of the filament 1 placed at the focal point 20 of said reflector 8.

Figure 5:
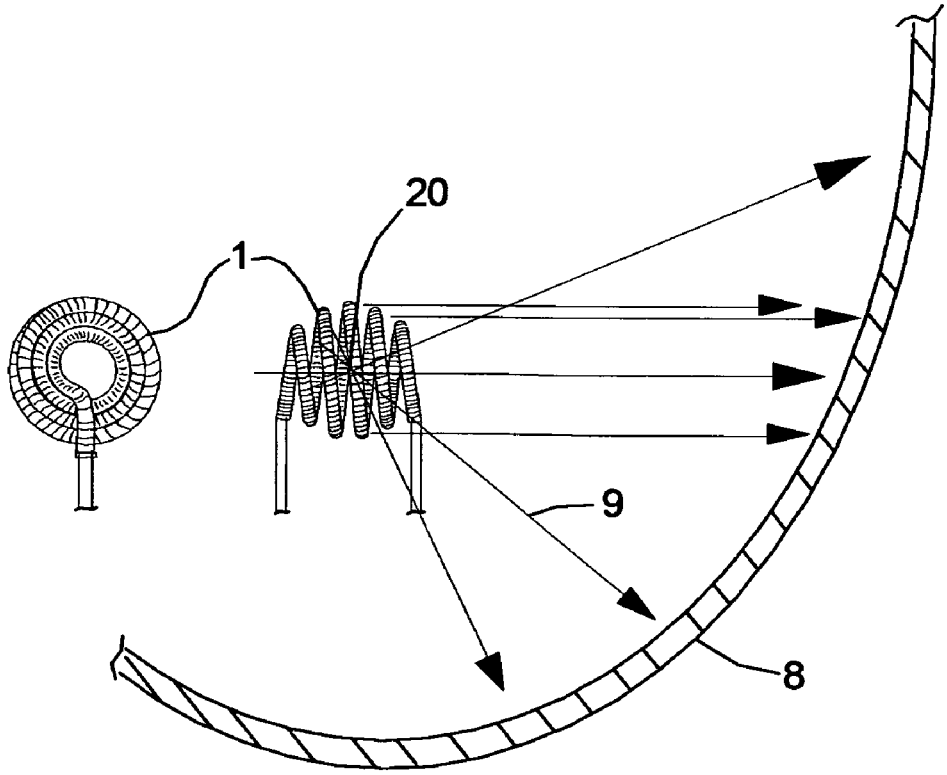
FIG. 5 is a schematic diagram of a side and front view of a spherically shaped coiled coil filament in accordance with the invention located at the focal point of a concave reflector.

This result is depicted in FIG. 5, which is a more detailed schematic drawing showing the filament 1 in a side view and with a front view placed at the focal point 20 of a concave reflector 8. Because of the circular and spherical nature of the coiled coils, substantially all points on the concave reflector 8 see this emitted light coming from the focal point 20, center of the filament 1. Light being emitted horizontally from the inside and outside segments of the larger center coiled coils of the filament 1 have more direct paths to emit rays 9 to the reflector 8 and thus increase efficiency.

The incandescent lamp 7 also shown in FIG. 10 includes a base having means for securing it to a part of the reflector 8, with the lamp's longitudinal axis aligned with the reflector's longitudinal axis and with the lamp's light-emitting filament 1 being positioned close to the reflector's focal point 20. A substantial portion of light emitted by the filament 1 projects radially outwardly to impinge on the reflector 8 and be redirected generally forward.

The diameter of the reflector can vary in size but the focal point 20 is substantially twenty five millimeters from the base 19 of said reflector 8.

It should be appreciated from the foregoing description that the present invention provides an improved incandescent lamp that is specially adapted for use in combination with a concave reflector in projecting a smoother, more controlled high-intensity beam of light. In each of several disclosed lamp embodiments, the lamp includes a coiled coil filament of a shape and size that allows more light radiated from the filament to impinge on the reflector and produce a more pleasing projected beam with a lesser number of hot spots, shadows, or clouding. In addition, the size and shape of the filament radiates the emitted light toward the reflector at angles which cause the light to be reflected substantially within the desired beam path, thus providing collection efficiency by maximizing the proportion of light emitted in the direction of the reflector to produce a beam of higher intensity.

Although the invention has been described in detail with reference to the presently preferred embodiments, those of ordinary skill in the art will appreciate that various modifications will be made without departing from the invention.

I claim:

1. An incandescent illumination system for projecting a beam of light, comprising:

a concave reflector configured to be substantially symmetrical about a longitudinal axis; and an incandescent lamp including a coiled coil filament wherein the larger coils of the coiled coil filament are wound to provide a spacing between adjacent coiled coils selected to be a distance the same as the filament coil diameter and arranged with a longitudinal axis of said filament oriented substantially perpendicular to the longitudinal axis of said concave reflector;

said spacing between adjacent coils reducing blocking or absorption of light radiation emanating from an interior of said coiled coil filament and providing a solid wave front of light aligned with a center of the filament and appearing to emanate from a center focal point of the concave reflector;

wherein a substantial portion of the light emitted by the lamp impinges on, and is redirected by, the reflector to project a high intensity beam of light.

2. An incandescent illumination system as defined in claim 1, wherein the curve of the concave reflector is substantially parabolic.

3. An incandescent illumination system as defined in claim 1, wherein the curve of the concave reflector is substantially ellipsoidal, and includes a gate having an aperture aligned with the longitudinal axis of the concave reflector; and a lens aligned with the longitudinal axis of the concave reflector and positioned on the side of the gate opposite the reflector and the incandescent lamp;

wherein a substantial portion of light emitted by the filament of the incandescent lamp is directed to impinge on the reflector, which redirects the light through the gate to the lens, to project the beam of light.

4. An incandescent illumination system as defined in claim 1, wherein:

the concave reflector is configured to have a focal point substantially twenty five millimeters from the base of said reflector;

and the incandescent lamp includes a coiled coil filament wherein the length, width, or height of said filament is not more than twelve millimeters.

5. An incandescent illumination system as defined in claim 4, wherein the curve of the concave reflector is substantially parabolic.

6. An incandescent illumination system as defined in claim 4, wherein the curve of the concave reflector is substantially ellipsoidal, and includes a gate having an aperture aligned with the longitudinal axis of the concave reflector; and a lens aligned with the longitudinal axis of the concave reflector and positioned on the side of the gate opposite the reflector and the incandescent lamp;

wherein a substantial portion of light emitted by the filament of the incandescent lamp is directed to impinge on the reflector, which redirects the light through the gate to the lens, to project the beam of light.

7. An incandescent illumination system as defined in claim 1, wherein the incandescent lamp coiled coil filament includes coiled coils of varying sizes to form a filament with a spherical overall shape.

8. An incandescent illumination system as defined in claim 7, wherein the curve of the concave reflector is substantially parabolic.

9. An incandescent illumination system as defined in claim 7, wherein the curve of the concave reflector is substantially ellipsoidal, and includes a gate having an aperture aligned with the longitudinal axis of the concave reflector; and a lens aligned with the longitudinal axis of the concave reflector and positioned on the side of the gate opposite the reflector and the incandescent lamp;

wherein a substantial portion of light emitted by the filament of the incandescent lamp is directed to impinge on the reflector, which redirects the light through the gate to the lens, to project the beam of light.

10. An incandescent illumination system as defined in claim 7, wherein the concave reflector is configured to have a focal point substantially twenty five millimeters from the base of said reflector;

and the incandescent lamp includes a coiled coil filament wherein the length, width, or height of said filament is not more than twelve millimeters.

11. An incandescent illumination system as defined in claim 10, wherein the curve of the concave reflector is substantially parabolic.

12. An incandescent illumination system as defined in claim 10, wherein the curve of the concave reflector is substantially ellipsoidal, and includes a gate having an aperture aligned with the longitudinal axis of the concave reflector; and a lens aligned with the longitudinal axis of the concave reflector and positioned on the side of the gate opposite the reflector and the incandescent lamp;

wherein a substantial portion of light emitted by the filament of the incandescent lamp is directed to impinge on the reflector, which redirects the light through the gate to the lens, to project the beam of light.

13. An incandescent lamp comprising:

a transparent glass bulb having a central longitudinal axis; and a base through which electrical power to the filament is provided; and a coiled coil filament located within the bulb and arranged with the longitudinal axes substantially perpendicular with the bulb axis;

wherein larger coils of the coiled coil filament are wound to provide a spacing between adjacent coiled coils selected to be a distance the same as the filament coil diameter to reduce blocking or absorption of light radiation emanating from an interior of said coiled coil filament and to provide a solid wave front of light aligned with a center of the filament.

14. An incandescent lamp as defined in claim 13, wherein the coiled coil filament includes coiled coils of varying sizes to form a filament with a spherical overall shape.

15. An incandescent lamp as defined in claim 13, wherein the length, width, or height of said filament is not more than twelve millimeters.

16. An incandescent lamp as defined in claim 15, wherein the coiled coil filament includes coiled coils of varying sizes to form a filament with a spherical overall shape.

17. An incandescent lamp as defined in claim 13, wherein the incandescent lamp further includes a concave reflector secured directly to a portion of the incandescent lamp.

18. An incandescent lamp as defined in claim 14, wherein the incandescent lamp further includes a concave reflector secured directly to a portion of the incandescent lamp.

19. An incandescent lamp as defined in claim 15, wherein the incandescent lamp further includes a concave reflector with a focal point twenty five millimeters from the base of said reflector secured directly to a portion of the incandescent lamp.

20. An incandescent lamp as defined in claim 16, wherein the incandescent lamp further includes a concave reflector with a focal point twenty five millimeters from the base of said reflector secured directly to a portion of the incandescent lamp.

* * * * *